US011414252B2

(12) United States Patent
Wise et al.

(10) Patent No.: US 11,414,252 B2
(45) Date of Patent: Aug. 16, 2022

(54) SYSTEM FOR PORT AND TUBE HOLDER ASSEMBLY ATTACHMENT DEVICE AND METHODS OF USE

(71) Applicant: Life Technologies Corporation, Carlsbad, CA (US)

(72) Inventors: Tristan Wise, West Nibley, UT (US); Charles Rhodes, Preston, ID (US)

(73) Assignee: Life Technologies Corporation, Carlsbad, CA (US)

( * ) Notice: Subject to any disclaimer, the term of this patent is extended or adjusted under 35 U.S.C. 154(b) by 0 days.

(21) Appl. No.: 17/005,071

(22) Filed: Aug. 27, 2020

(65) Prior Publication Data

US 2020/0391923 A1 Dec. 17, 2020

Related U.S. Application Data

(63) Continuation of application No. 16/278,845, filed on Feb. 19, 2019, now Pat. No. 10,759,584.
(Continued)

(51) Int. Cl.
*B65D 77/06* (2006.01)
*B65D 83/00* (2006.01)
(Continued)

(52) U.S. Cl.
CPC ..... *B65D 77/067* (2013.01); *B01L 3/52* (2013.01); *B65D 83/0077* (2013.01);
(Continued)

(58) Field of Classification Search
CPC .. B65D 77/067; B65D 83/0077; B65D 83/28; B65D 2590/0066; B65D 2583/005;
(Continued)

(56) References Cited

U.S. PATENT DOCUMENTS 301,753 A 7/1884 Porter et al.
508,408 A 11/1893 Cogswell
(Continued)

FOREIGN PATENT DOCUMENTS

CN 105508761 A 4/2016
CN 206802556 U 12/2017
(Continued)

OTHER PUBLICATIONS

International Search Report and Written Opinion dated May 9, 2019, issued in PCT Application No. PCT/US2019/018458, filed Feb. 19, 2019.
The Flexel 3-D System Stedium, Inc. 1998.

*Primary Examiner* — Frederick C Nicolas
(74) *Attorney, Agent, or Firm* — Workman Nydegger

(57) ABSTRACT

A positioning apparatus for restraining an object includes a base plate, an attachment plate, and a securing element. The base plate may include guides into which protrusions of the attachment plate slide to alter the positioning apparatus from an open position to a closed position. The base plate also includes receivers to receive tubular members, which have their movement restrained by the receivers and the securing elements in the closed position. The positioning apparatus may also include a latch to help maintain the closed position during operation.

17 Claims, 18 Drawing Sheets

Related U.S. Application Data

(60) Provisional application No. 62/637,462, filed on Mar. 2, 2018.

(51) Int. Cl.

| | |
|---|---|
| ***B65D 83/28*** | (2006.01) |
| ***B01L 3/00*** | (2006.01) |
| *A61J 1/10* | (2006.01) |
| *B01L 9/04* | (2006.01) |
| *B01L 9/00* | (2006.01) |

(52) U.S. Cl.
CPC ..... *B65D 83/28* (2013.01); *A61J 1/10* (2013.01); *B01L 9/04* (2013.01); *B01L 9/50* (2013.01); *B01L 2200/023* (2013.01); *B01L 2200/025* (2013.01); *B01L 2200/18* (2013.01); *B01L 2300/0848* (2013.01); *B01L 2300/123* (2013.01); *B65D 2583/005* (2013.01); *B65D 2590/0066* (2013.01)

(58) Field of Classification Search
CPC ..... B01L 3/52; B01L 2200/18; B01L 2300/0848; B01L 2300/123; B01L 9/04; B01L 9/50; B01L 2200/023; B01L 2200/025; A61J 1/10
See application file for complete search history.

(56) References Cited

U.S. PATENT DOCUMENTS

| | | | | |
|---|---|---|---|---|
| 797,215 | A | | 8/1905 | Osborne et al. |
| 901,034 | A | | 10/1908 | Patterson |
| 935,075 | A | | 9/1909 | Wemhoff |
| 1,118,738 | A | | 11/1914 | Carroll |
| 1,272,222 | A | | 7/1918 | Clayton |
| 2,315,365 | A | | 3/1943 | Christy |
| 2,579,685 | A | | 12/1951 | Loose |
| 2,649,991 | A | | 8/1953 | Woock |
| 2,720,998 | A | | 10/1955 | Potter |
| 2,805,793 | A | | 9/1957 | Crisafulli |
| 2,826,329 | A | | 3/1958 | Beckner |
| 2,894,666 | A | | 7/1959 | Champbell, Jr. |
| 2,916,161 | A | | 12/1959 | Schaefer |
| 2,973,119 | A | | 2/1961 | Parker |
| 3,096,551 | A | | 7/1963 | Shoberg |
| 3,105,617 | A | | 10/1963 | Felldin |
| 3,212,681 | A | | 10/1965 | Weikert |
| 3,343,719 | A | | 9/1967 | Kastamo et al. |
| 3,477,686 | A | | 11/1969 | Engelsher et al. |
| 3,481,511 | A | | 12/1969 | Metke |
| 3,735,898 | A | | 5/1973 | Smith |
| 3,735,989 | A | | 5/1973 | Smith |
| 3,874,569 | A | | 4/1975 | Fossett et al. |
| 3,908,864 | A | | 9/1975 | Capper |
| 3,960,294 | A | | 6/1976 | Bernard |
| 3,982,724 | A | | 9/1976 | Citrin |
| 4,119,263 | A | | 10/1978 | Cuthbertson et al. |
| 4,271,987 | A | | 6/1981 | Eriksson et al. |
| 4,390,051 | A | | 6/1983 | Cuthbertson |
| 4,436,277 | A | | 3/1984 | Robak |
| D274,127 | S | | 6/1984 | Ruediger et al. |
| 4,591,065 | A | | 5/1986 | Foy |
| 4,666,064 | A | | 5/1987 | Hoehn |
| 4,785,974 | A | | 11/1988 | Rudick |
| 4,804,118 | A | | 2/1989 | Mullen |
| 4,807,845 | A | | 2/1989 | Damell |
| 4,817,824 | A | | 4/1989 | LaFleur et al. |
| 4,883,201 | A | | 11/1989 | Poulton |
| 4,953,754 | A | | 9/1990 | Credle, Jr. |
| 4,968,078 | A | | 11/1990 | Fizwater et al. |
| 5,000,352 | A | | 3/1991 | Cleland |
| 5,033,649 | A | | 7/1991 | Copeland et al. |
| 5,205,772 | A | | 11/1993 | Bartasevich |
| 5,265,772 | A | | 11/1993 | Bartasevich |
| 5,333,777 | A | | 8/1994 | Roth |
| 5,379,917 | A | | 1/1995 | Brown |
| 5,383,576 | A | | 1/1995 | Richter et al. |
| 5,402,915 | A | | 4/1995 | Hogan |
| 5,425,400 | A | * | 6/1995 | Szatmary ..... B01L 1/02 141/346 |
| 2,718,985 | A | | 9/1995 | Tamminga |
| D371,497 | S | | 7/1996 | Conttone |
| 5,531,352 | A | | 7/1996 | Kraft et al. |
| 5,549,707 | A | | 8/1996 | Weaver |
| 5,584,327 | A | | 12/1996 | Thomas et al. |
| 5,595,324 | A | | 1/1997 | Brown |
| 5,673,817 | A | | 10/1997 | Mullen et al. |
| 5,802,689 | A | * | 9/1998 | Sano ..... B29C 66/522 29/33 T |
| 5,810,204 | A | | 9/1998 | Deviln et al. |
| 5,873,498 | A | | 2/1999 | Moore et al. |
| 5,897,012 | A | | 4/1999 | Sortwell |
| 5,944,227 | A | | 8/1999 | Schroeder et al. |
| 5,947,337 | A | | 9/1999 | Rudick et al. |
| 5,988,422 | A | | 11/1999 | Vallot |
| D421,715 | S | | 3/2000 | Jen-Chen |
| 6,036,058 | A | | 3/2000 | Chou |
| 6,068,162 | A | | 5/2000 | De Winter |
| 6,076,457 | A | | 6/2000 | Vallot |
| D436,814 | S | | 1/2001 | Gore et al. |
| 6,186,932 | B1 | | 2/2001 | Vallot |
| 6,196,420 | B1 | | 3/2001 | Gutierrez |
| 6,202,708 | B1 | | 3/2001 | Bynum |
| 6,223,903 | B1 | | 5/2001 | Mansouri |
| 6,253,806 | B1 | | 7/2001 | Sperry et al. |
| 6,286,700 | B1 | | 9/2001 | Davidson |
| 6,302,299 | B1 | | 10/2001 | Baker et al. |
| 6,345,734 | B2 | | 2/2002 | Schalow et al. |
| D454,777 | S | | 3/2002 | Yoshiguchi et al. |
| D465,408 | S | | 11/2002 | Man et al. |
| 6,543,495 | B2 | | 4/2003 | Hougland |
| 6,634,783 | B2 | | 10/2003 | Baron |
| 6,659,132 | B2 | | 12/2003 | Smith et al. |
| 6,929,155 | B1 | | 8/2005 | Sayers |
| D513,172 | S | | 12/2005 | Rutsky et al. |
| 7,284,579 | B2 | * | 10/2007 | Elgan ..... B65D 19/08 141/10 |
| D563,781 | S | | 3/2008 | Carnevali et al. |
| 7,588,161 | B2 | | 9/2009 | Elgan et al. |
| 7,922,848 | B2 | * | 4/2011 | Ishida ..... B29C 66/91651 156/159 |
| 8,342,368 | B2 | * | 1/2013 | Ophardt ..... G01F 11/125 222/181.3 |
| 8,376,310 | B2 | | 2/2013 | Veltrop |
| 8,636,176 | B2 | | 1/2014 | Malin |
| 9,533,869 | B2 | | 1/2017 | Veltrop |
| D793,852 | S | | 8/2017 | Rathman et al. |
| D808,788 | S | | 1/2018 | Ackerman et al. |
| 9,988,257 | B2 | | 6/2018 | Schneberger |
| 10,060,539 | B2 | | 8/2018 | Wilson |
| D835,505 | S | | 12/2018 | De Los Santos |
| 10,759,584 | B2 | * | 9/2020 | Wise ..... B01L 3/52 |
| 2004/0027912 | A1 | | 2/2004 | Bibbo et al. |
| 2004/0074922 | A1 | | 4/2004 | Bother et al. |
| 2004/0149766 | A1 | | 8/2004 | Karpisek |
| 2005/0045639 | A1 | | 3/2005 | Thorpe |
| 2006/0145105 | A1 | | 7/2006 | Ishida |
| 2011/0271646 | A1 | | 11/2011 | Elgan et al. |
| 2012/0067920 | A1 | | 3/2012 | Veltrop |
| 2013/0237956 | A1 | | 9/2013 | Travis et al. |
| 2015/0117142 | A1 | | 4/2015 | Staheli et al. |

FOREIGN PATENT DOCUMENTS

| | | | |
|---|---|---|---|
| DE | 4039836 | A1 | 6/1992 |
| EP | 72783 | | 2/1983 |
| EP | 586994 | A1 | 3/1994 |
| GB | 2069461 | A | 8/1981 |
| GB | 2078678 | A | 1/1982 |
| WO | 1993/017930 | A1 | 9/1993 |

* cited by examiner

SYSTEM FOR PORT AND TUBE HOLDER ASSEMBLY ATTACHMENT DEVICE AND METHODS OF USE

CROSS-REFERENCE TO RELATED APPLICATIONS

This application is a continuation of U.S. application Ser. No. 16/278,845, filed Feb. 19, 2019, which claims benefit of U.S. Provisional Application No. 62/637,462, filed Mar. 2, 2018, which are incorporated herein by specific reference.

BACKGROUND OF THE INVENTION

1. The Field of the Invention

The present invention relates to bins for use in storing, moving, processing and/or dispensing fluids.

2. The Relevant Technology

The biopharmaceutical industry uses large quantities of different types of fluids in their research, testing, and production of final product. Examples of such fluids include media, buffers, and reagents. Critical to the biopharmaceutical industry is the ability to easily transport, process, and dispense such fluids while preventing unwanted contamination. Historically such fluids have been held in stainless steel containers which required cleaning and sterilization between uses. To avoid the burden of repeated tank cleaning, current approaches to the storage and dispensing of fluids have utilized fluid dispensing bins.

Conventional fluid dispensing bins comprise an open top bin having a fixed floor with a fixed porthole extending therethrough. A disposable bag having a fluid line extending therefrom is disposed within the bin so that the fluid line extends out of the porthole. The disposable bag can be pre-sterilized so as to prevent contamination of fluids that pass there-through. Once the bag is filled with fluid, the bag provides a ready supply of the fluid for desired processing. Once the bag is empty, the bag can be replaced with a new bag without cleaning.

Although conventional fluid dispensing bins are useful, they have a number of shortcomings. For example, conventional fluid dispensing bins have a fixed floor with a fixed porthole configuration so that the customer is required to purchase from the bin manufacturer the corresponding bag that is designed to fit the bin. As a result, customers are limited in their ability to purchase bags from other producers in that the bags may not fit properly within the bin. Furthermore, due to the fixed nature of the bins, customers are unable to request customized bag designs that may be more useful under different processing or dispensing conditions. In addition, bags are often preassembled and then sterilized with other structures such as filters. However, once a filter or other structure is secured to the fluid line extending from a bag, the bag can no longer be used with the bin in that the filter cannot be passed through the fixed port hole on the floor of the bin.

Accordingly, there is an ongoing need in the art for fluid dispensing bins that can be easily used with a broad range of bag designs and bag assemblies.

The biopharmaceutical industry has been increasingly using disposable media bags for product processing. The media bags, being filled with liquid, require a media bag holder to contain the filled media bag. The media bags may have a combination of top and bottom tubing in various quantities and configurations. The bottom tubing requires a means of passing through the bottom of the bag holder and being held in place. One prior method to accommodate media bag tubing is to provide fixed holes in the bottom of the bag holder with either no retaining device or simple clamping type devices in line with the holes underneath the bottom of the bag holder.

Another method is two movable bottom pieces, each with one half of the required hole, which when brought together clamp onto the media bag tubing. Fixed holes in the bottom of the media bag holder allow for only one configuration of media bag tubing, both size of tubing and position. The clamping devices must be placed on the bottom of the bag holder which requires reaching underneath the bag holder, which may only be inches off the floor, making it difficult to see and access.

Two movable bottom pieces do allow changing of pieces to accommodate various tubing configurations, but require locking devices which must also be placed on the bottom of the bag holder and are often difficult to see and access.

BRIEF SUMMARY

Described herein are embodiments of a fluid line retainer that centralizes the ports during deployment of the bag and secures them in place such that they function properly once the bag is deployed. When draining, the placement of the ports affects the ability of the bag to drain properly. The bottom of the bin slopes toward the front and the ports are at the front of the bins and are held in place by the port holders. The port holders may have multiple design options. One embodiment is a 'pinball'-style design that has springs to automatically adjust to the size of tubing that is placed into the port holder. Other embodiments include a screw-style design and a cover-style design. The screw-style and pinball-style designs may adjust from 1.5" tubing and smaller, whereas the cover-style design may just hold the tubing in place.

BRIEF DESCRIPTION OF THE SEVERAL VIEW OF THE DRAWINGS

To easily identify the discussion of any particular element or act, the most significant digit or digits in a reference number refer to the figure number in which that element is first or most clearly introduced.

DETAILED DESCRIPTION

Figure 1:
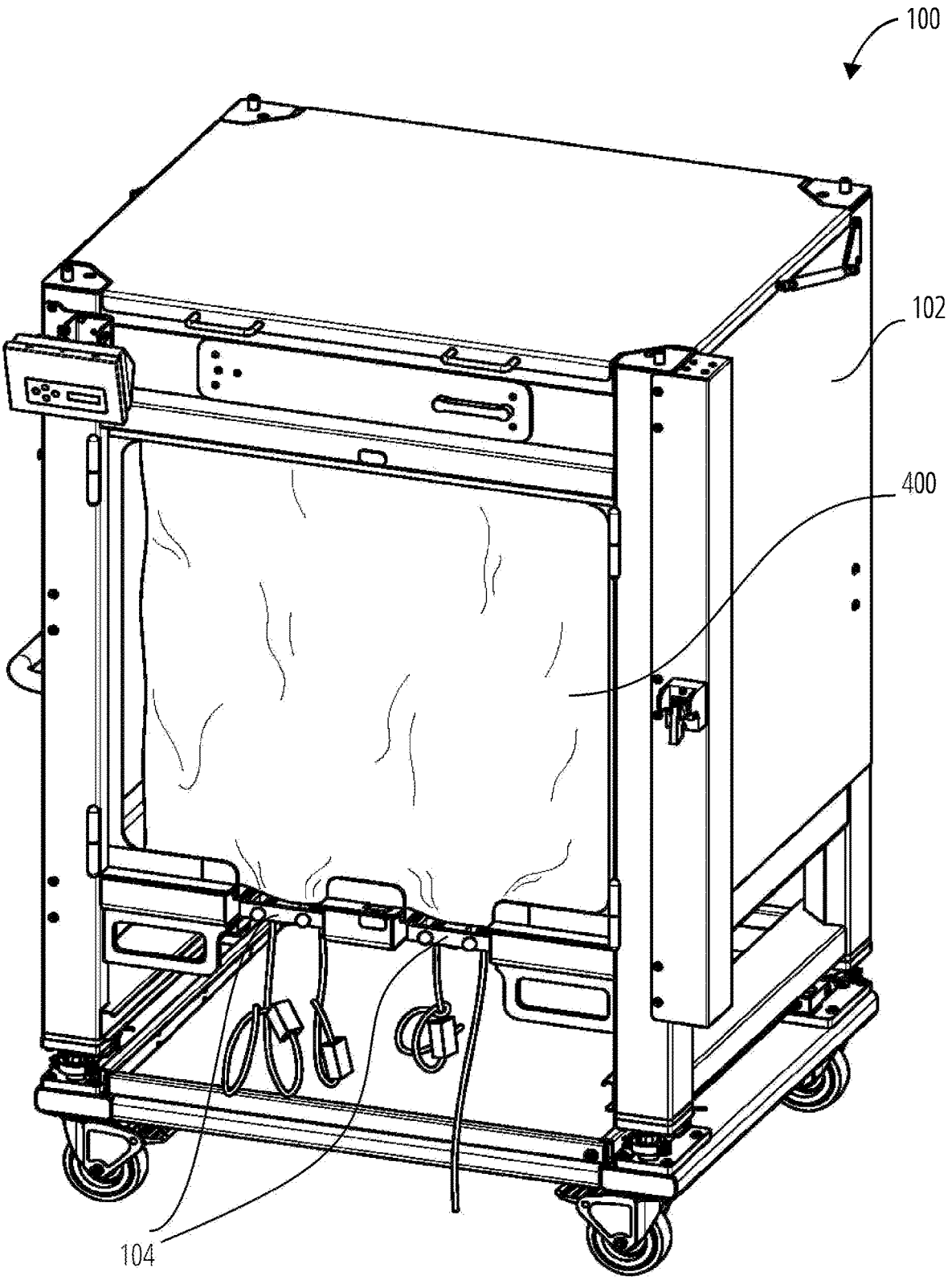
FIG. 1 illustrates a front perspective view of an embodiment of a liquid dispensing system 100.
Figure 2:
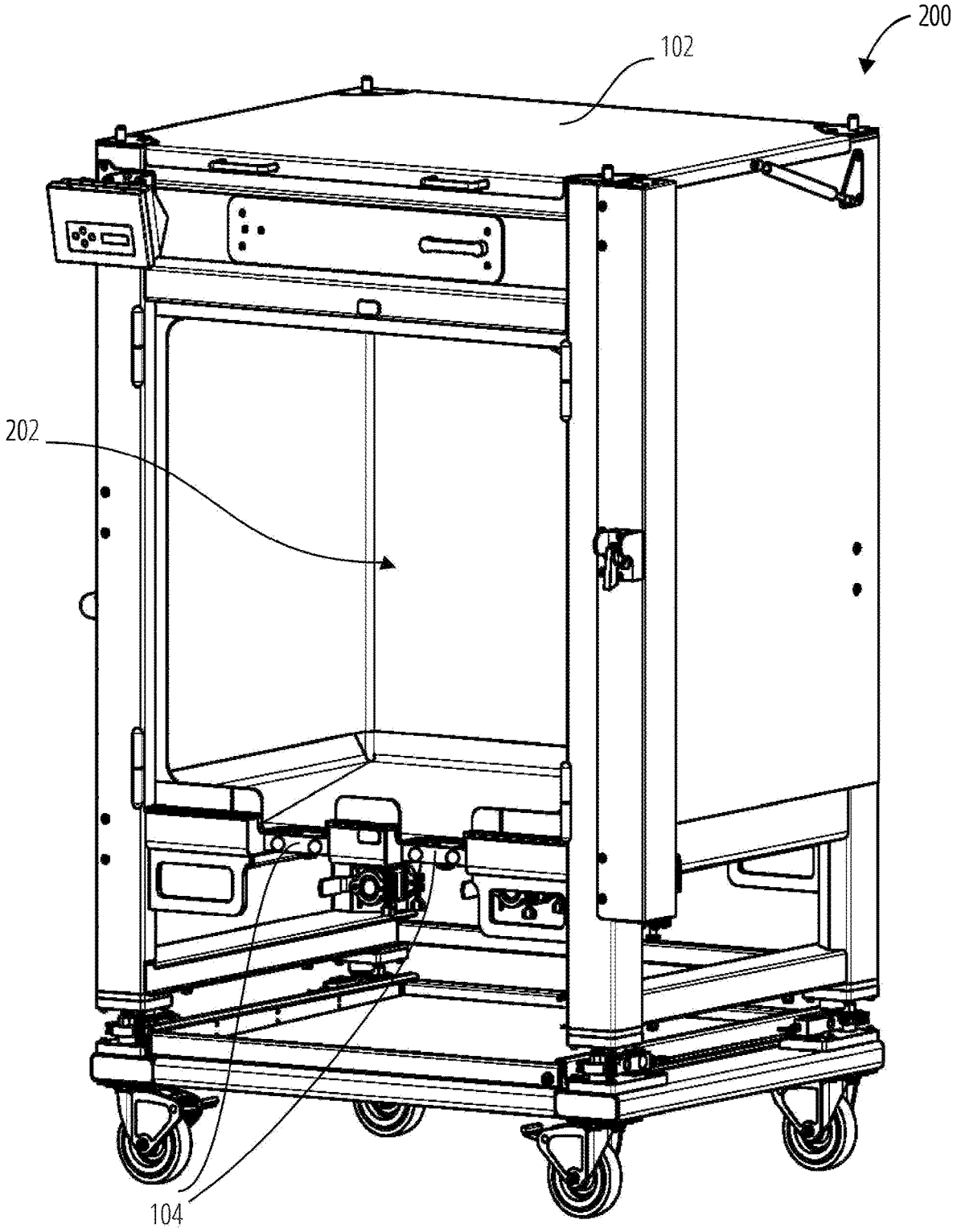
FIG. 2 illustrates a front perspective view of an embodiment of a cabinet 200.
Figure 3:
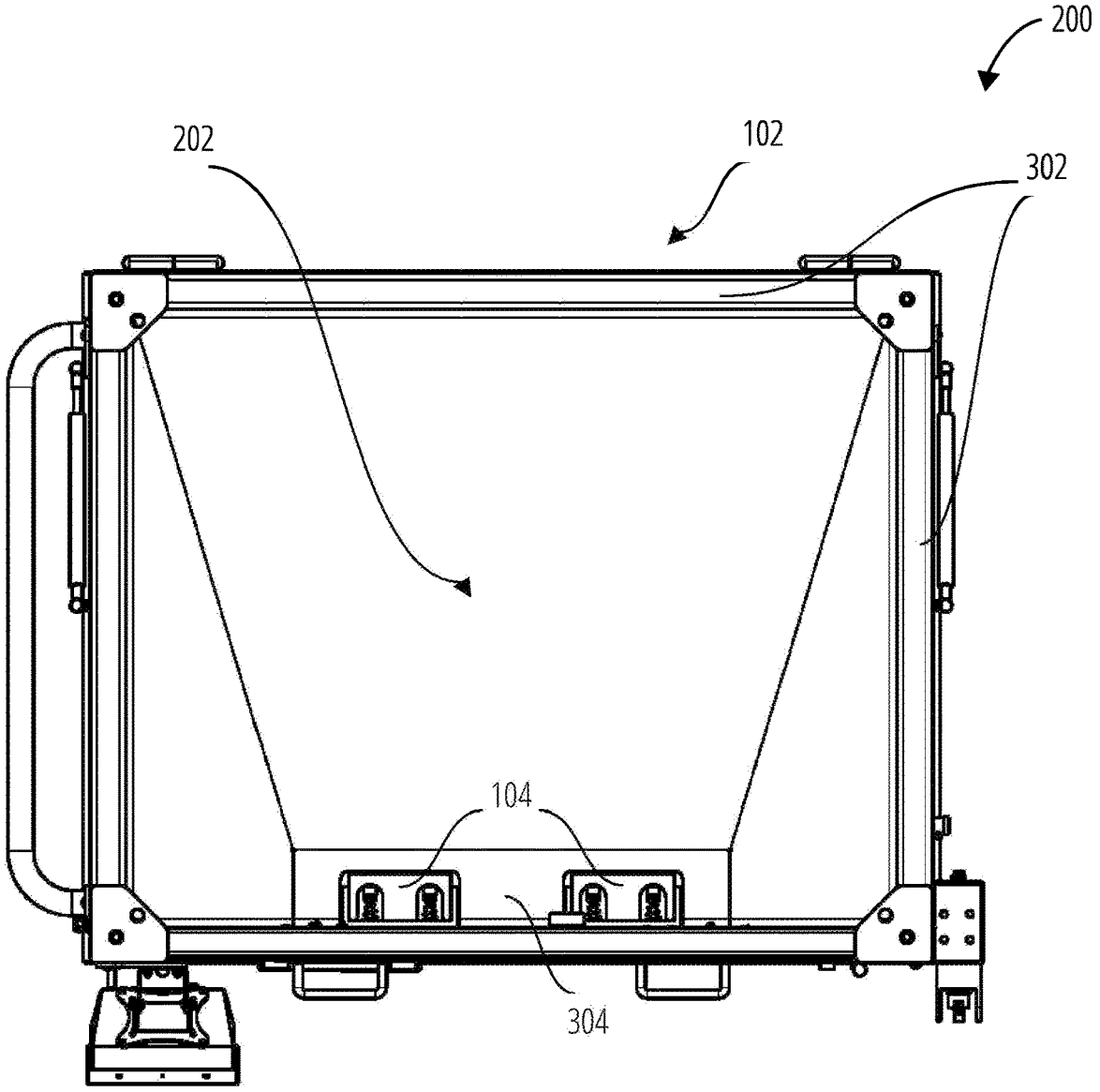
FIG. 3 illustrates a top view of an embodiment of a cabinet 200.
Figure 4:
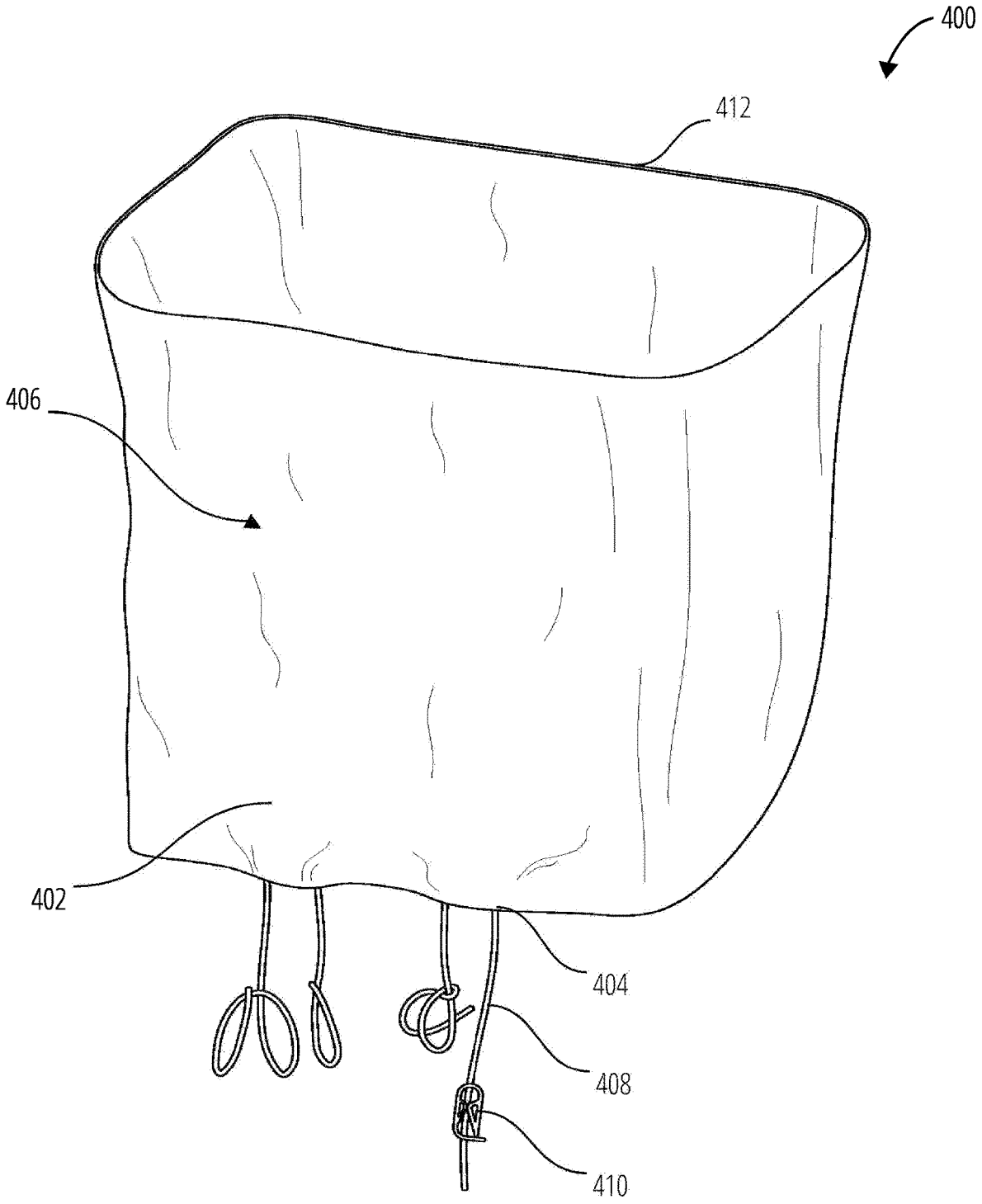
FIG. 4 illustrates an embodiment of a flexible container 400.
Figure 5:
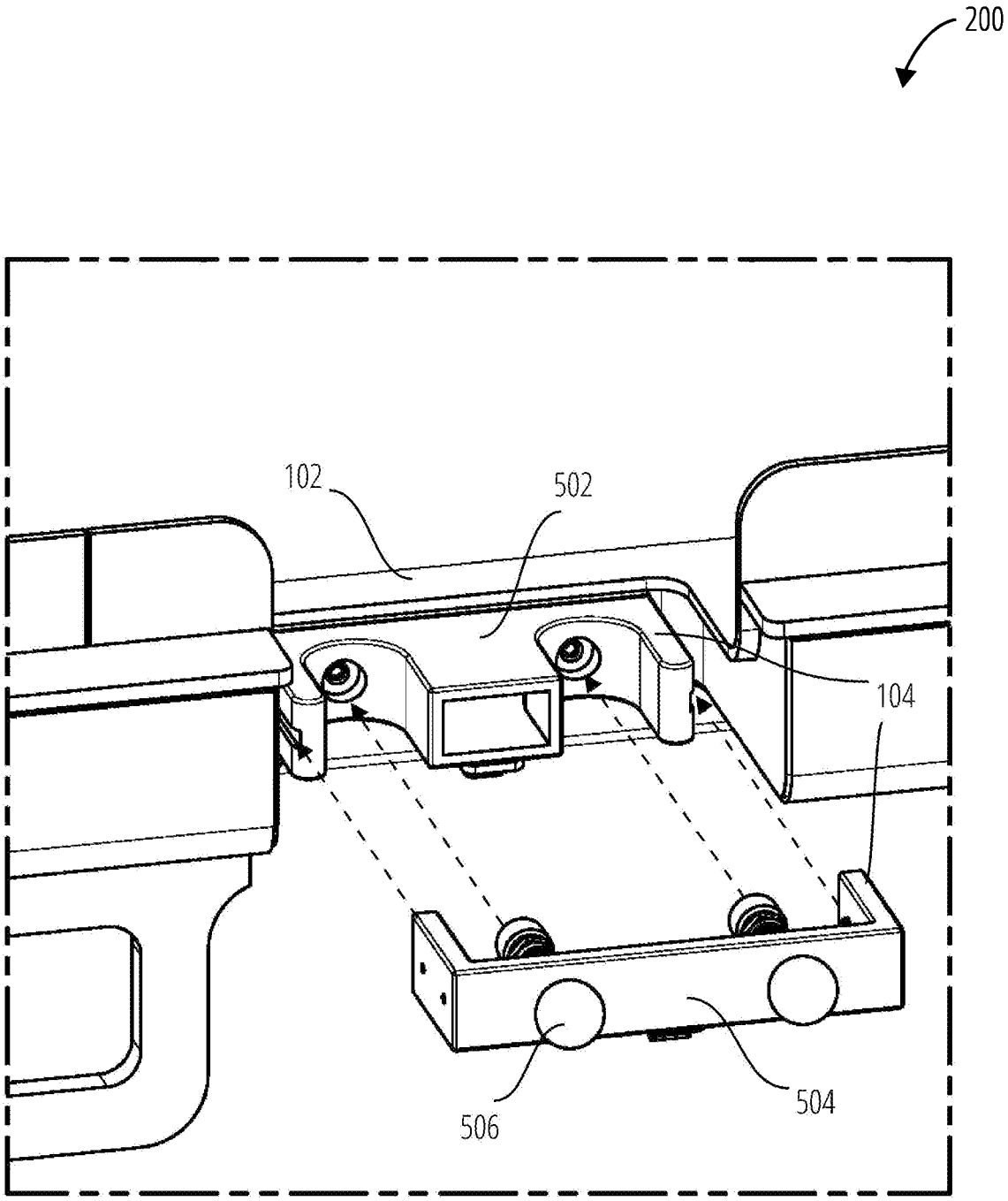
FIG. 5 illustrates an enhanced perspective view of an embodiment of a cabinet 200.
Figure 6:
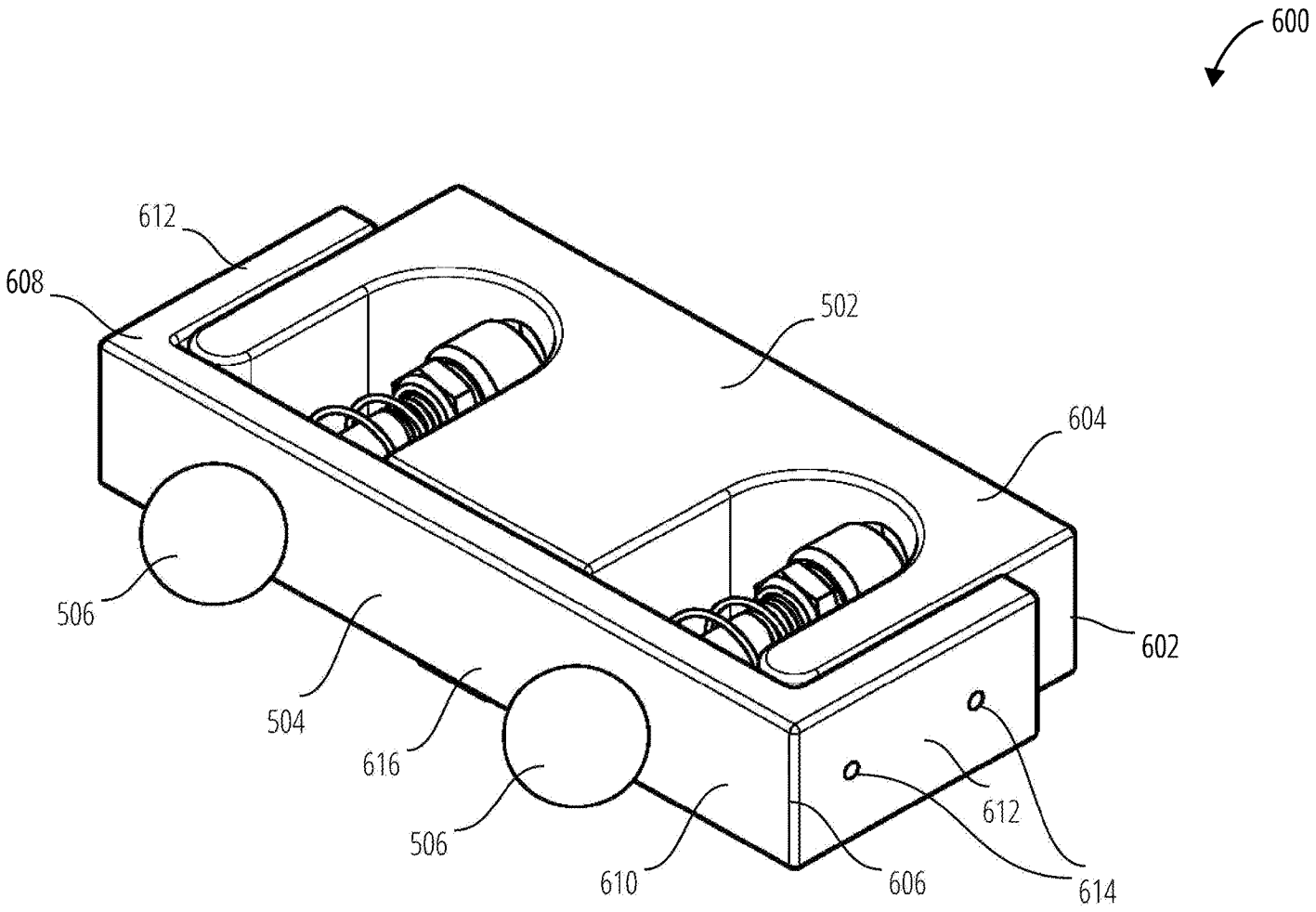
FIG. 6 illustrates a top perspective assembly view of an embodiment of a pinball-style tube holder 600 in a closed position.
Figure 7:
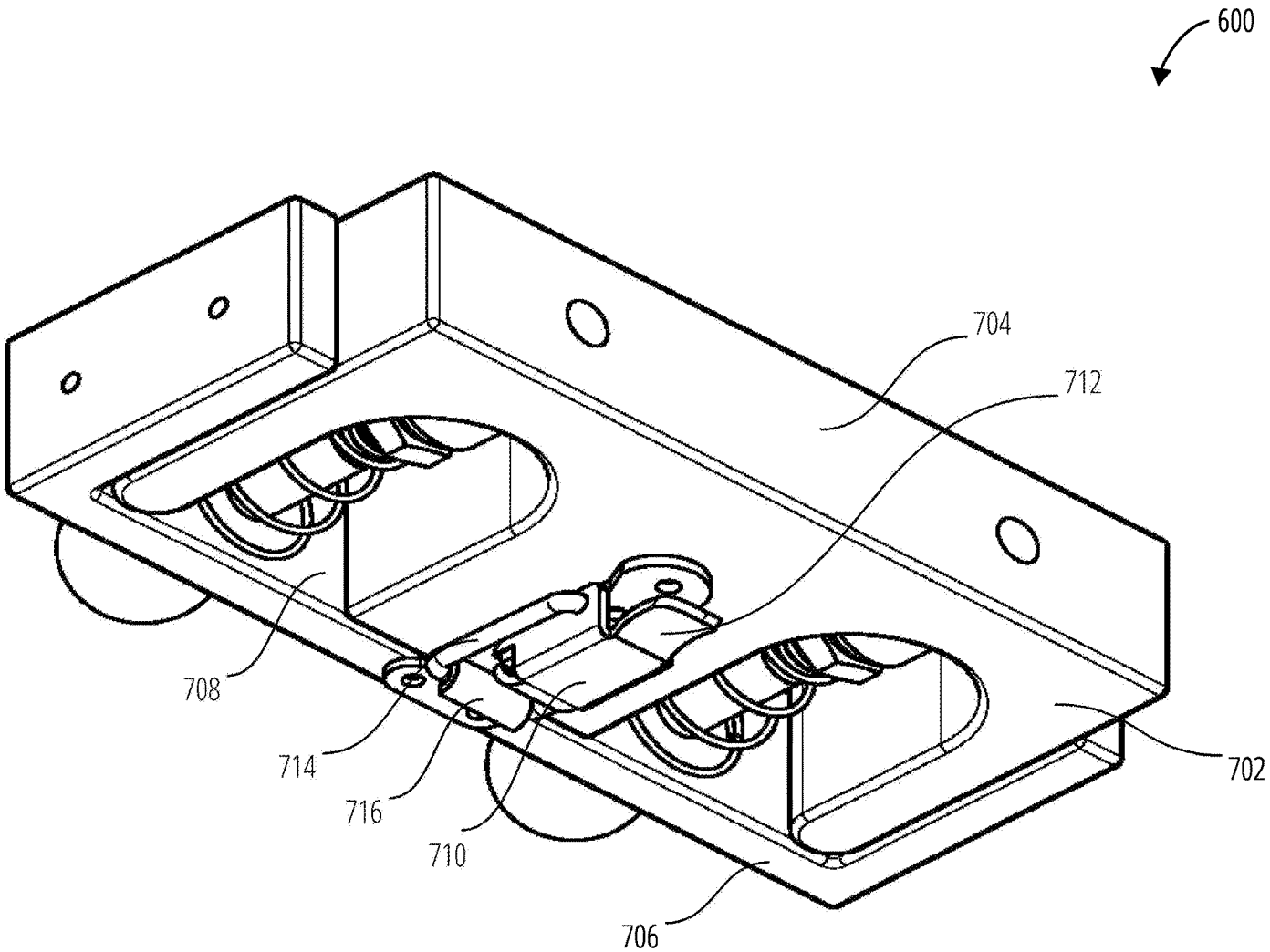
FIG. 7 illustrates a bottom perspective assembly view of an embodiment of a pinball-style tube holder 600 in a closed position.
Figure 8:
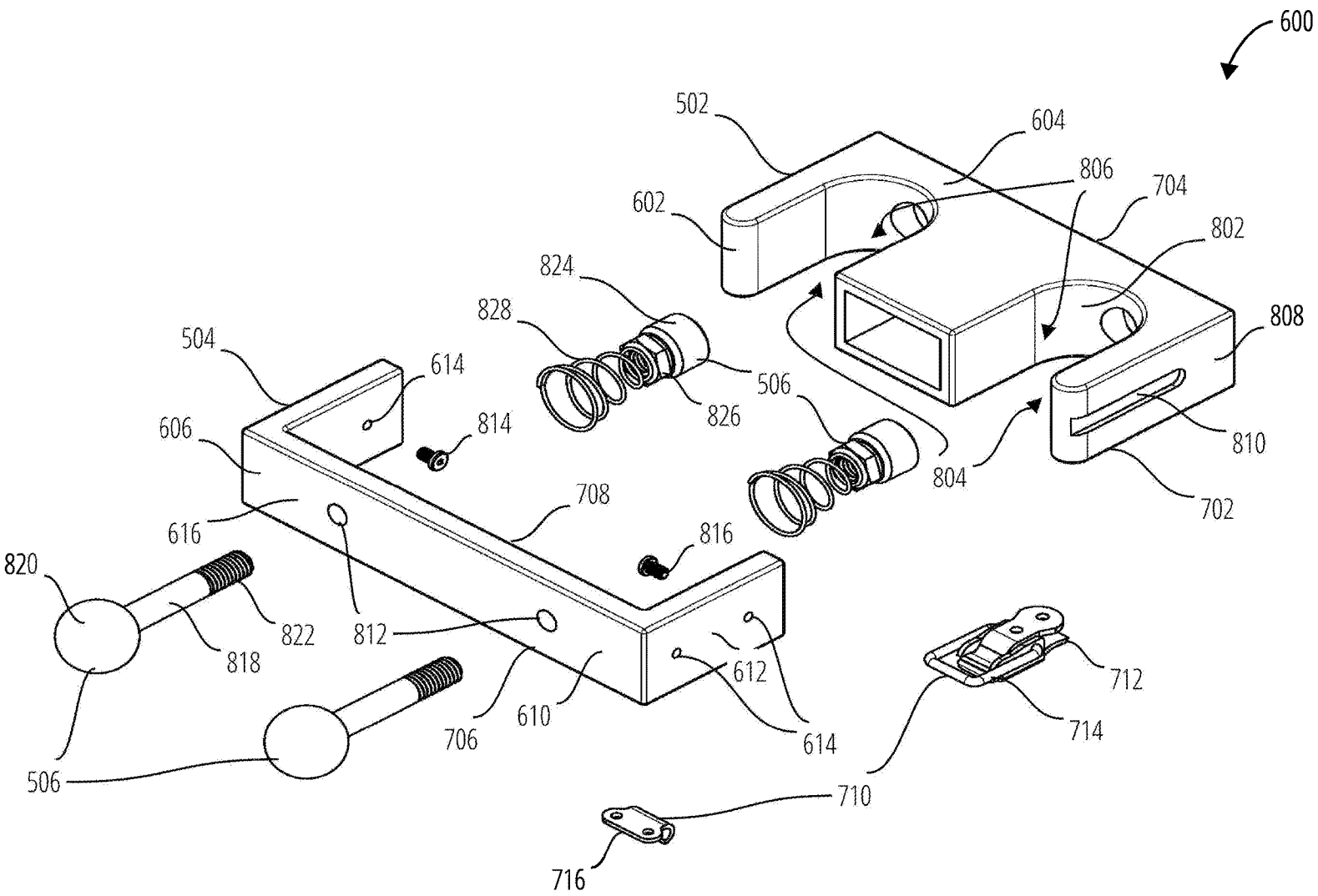
FIG. 8 illustrates a top perspective exploded view of an embodiment of a pinball-style tube holder 600.
Figure 9:
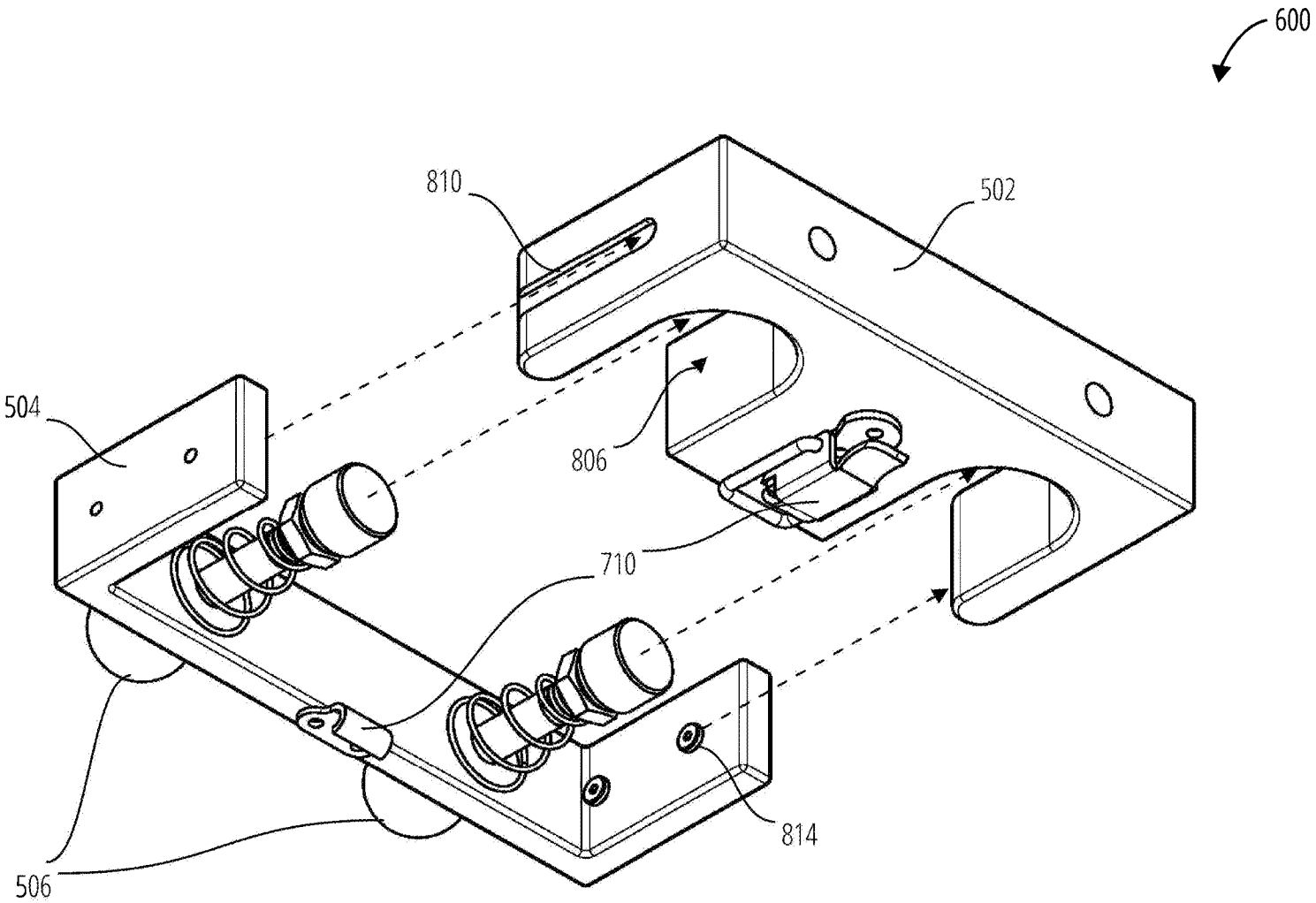
FIG. 9 illustrates a bottom perspective assembly view of an embodiment of a pinball-style tube holder 600 in an open position.
Figure 10:
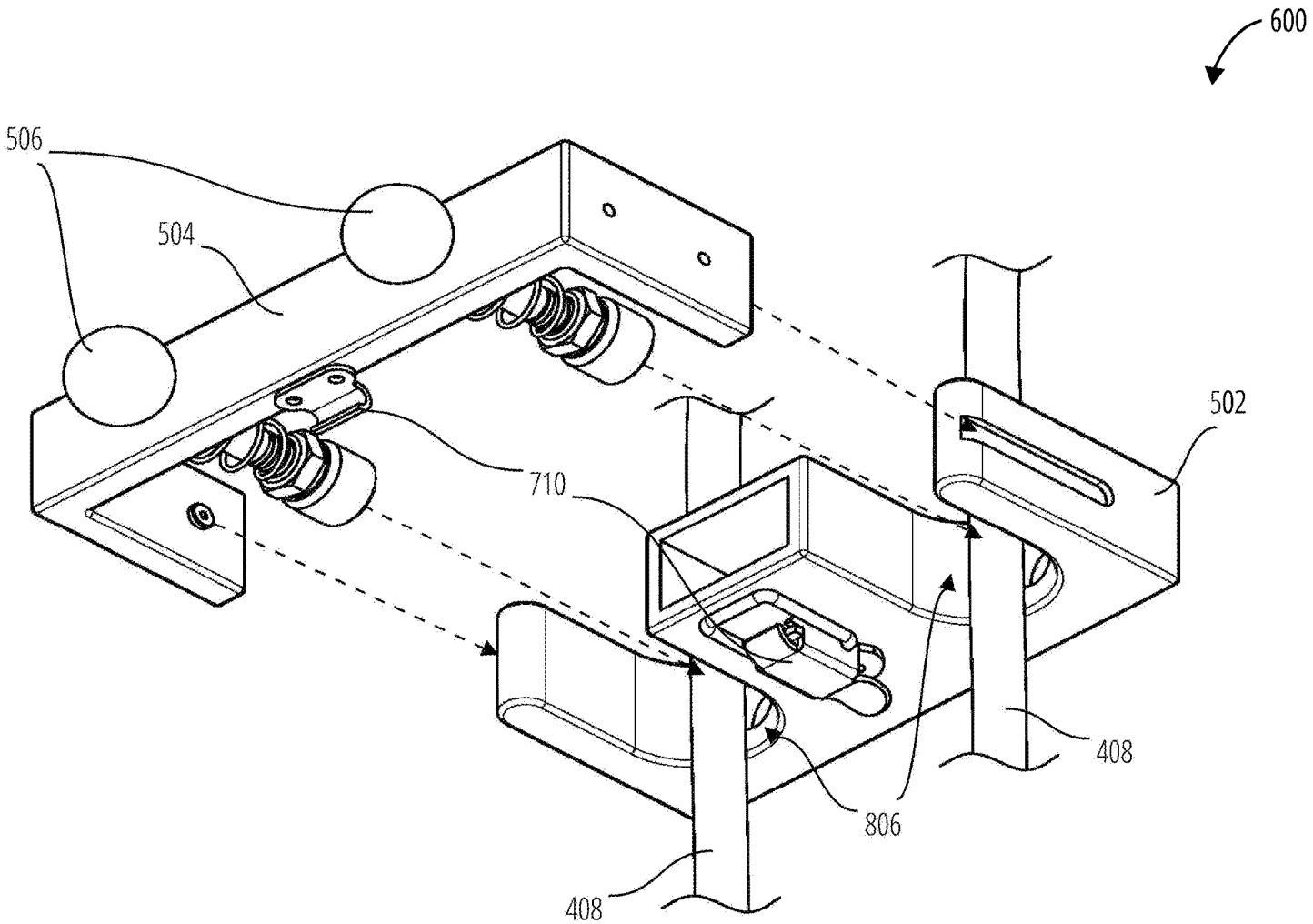
FIG. 10 illustrates a bottom perspective assembly view of an embodiment of a pinball-style tube holder 600 in an open position.
Figure 11:
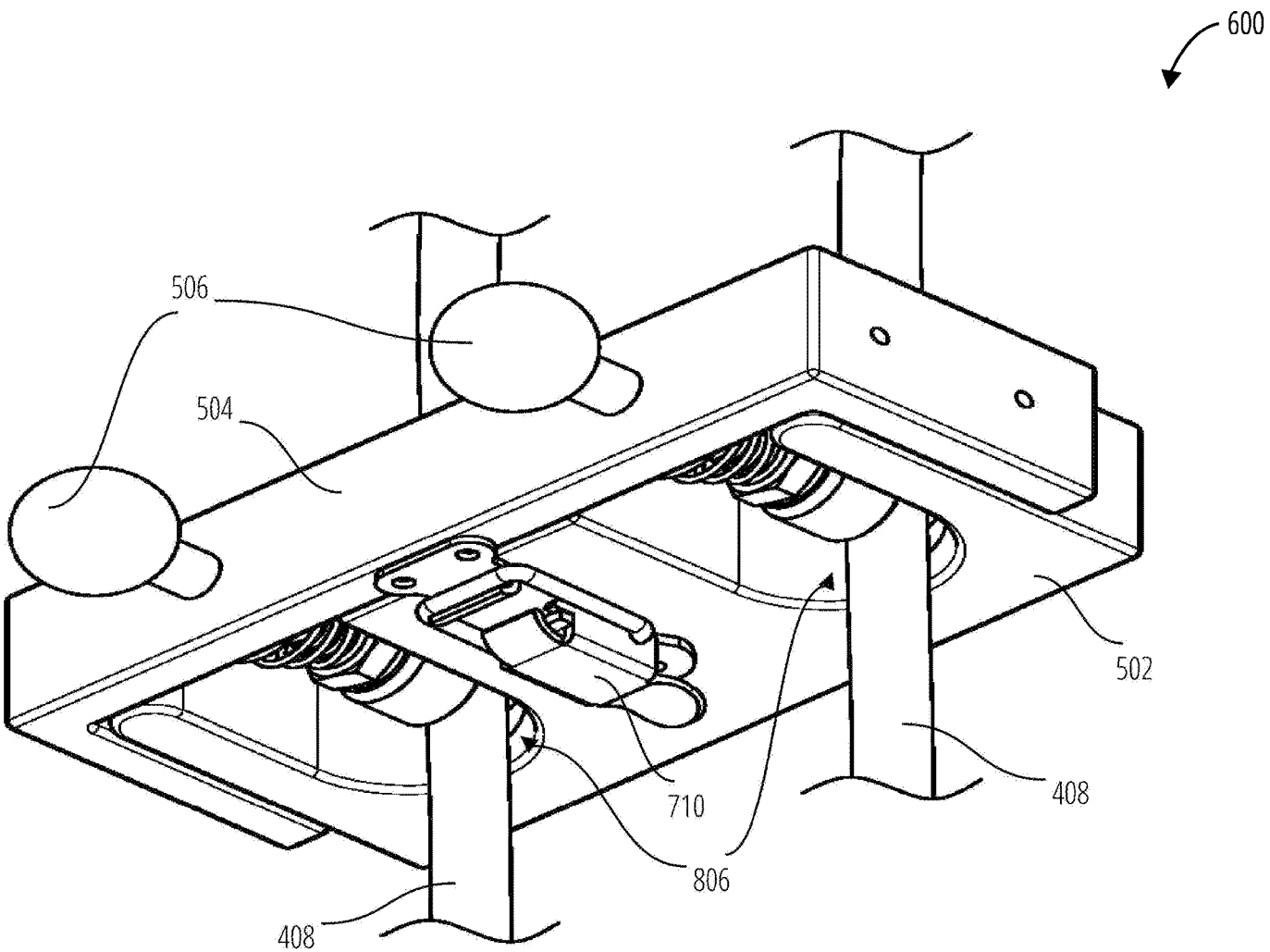
FIG. 11 illustrates a bottom perspective assembly view of an embodiment of a pinball-style tube holder 600 in a closed position.

Referring to FIG. 1-FIG. 5, a liquid dispensing system 100 comprises a rigid housing 102, a positioning apparatus 104, and a flexible container 400.

The rigid housing 102 may comprise sidewalls 302 and a floor 304 to form a cavity 202 into which the flexible container 400 may be placed. The sidewalls 302 may be upstanding on the exterior surface and sloped from the top of the rigid housing 102 to the floor 304 of the rigid housing 102 on the interior surface. The slope and the contour of the sidewalls 302 and the position of the floor 304 relative to the top of the rigid housing 102 determines the shape of the cavity 202 into which the flexible container 400 may be placed. The liquid dispensing system 100 may have further structural elements to alter the height off the floor 304 and to provide transportability.

The flexible container 400 may comprise a compartment 402 that may hold a liquid 406 and may have one or more opening 404. One of more tubular members 408 may be coupled to the compartment 402 at each opening 404. The liquid 406 may flow from the compartment 402 through the opening 404 and into the tubular member 408, which conveys the liquid from the interior of the compartment 402 to the exterior of the compartment 402, removing the liquid from the flexible container 400. The flow of the liquid 406 may be regulated by the retention device 410. The flexible container 400 may be shaped similar to a cube with panels that are welded together on each corner. The flexible container 400 may further have ports, tubes, tabs, etc. As depicted, the flexible container 400 has a top portion 412 that is open. In other embodiments, the top portion 412 may be closed. The flexible container 400 may have further components that may attach to the rigid housing 102, or a component of the rigid housing 102, such as a hoist (not depicted), to position and orient the flexible container 400 within the rigid housing 102. Multiple flexible containers 400 may be placed within the rigid housing 102. The flexible container 400 may be placed within the cavity 202 of the rigid housing 102 and conform to the shape of the cavity 202 as determined by the rigid housing 102.

The positioning apparatus 104 is affixed to the rigid housing 102. The positioning apparatus 104 may act as a support by contacting and restraining one or more objects, such as the tubular member 408. The one or more positioning apparatus 104 may be affixed to the rigid housing 102. The positioning apparatus 104 may further comprise a base plate 502, an attachment plate 504, and a securing element 506. The base plate 502 may be affixed to the rigid housing 102. The attachment plate 504 may be aligned to the base plate 502 and secured to the base plate 502. The securing element 506 may extend from the attachment plate 504 and be configured to retract toward the attachment plate 504. The base plate 502 and the securing element 506 are adapted to restrain movement of the tubular member 408 when the positioning apparatus 104 is altered from an open position to a closed position. Exemplary embodiments of the positioning apparatus 104 are depicted as the pinball-style tube holder 600, the screw-style tube holder 1200, and the cover-style tube holder 1400 in reference to FIG. 6-FIG. 15.

Referring to FIG. 6-FIG. 11, a pinball-style tube holder 600 is depicted in various views and positions. The pinball-style tube holder 600 comprises a base plate 502, an attachment plate 504, a securing element 506, and a latch 710.

The base plate 502 comprises a perimeter 602 that joins a top surface 604 to a bottom surface 702. The perimeter 602 has a back portion 704, a curvature 802, and one or more sidewalls 808. The curvature 802 encircles and defines the hollow portions 804 of the base plate 502. The curvature 802 and the hollow portions 804 form the receivers 806. As depicted the base plate 502 has a second curvature encircling and defining a second hollow portion forming a second receiver. Each of the receivers 806 may receive a tubular member 408. In some embodiments, the base plate 502 may comprise a single receiver or multiple receivers. Each sidewall 808 may comprise a guide 810. The guide 810 may be mounted onto an indentation into the sidewall 808 and extend from the front of the base plate 502 toward the back portion 704 of the base plate 502. Each guide 810 may be configured to receive a protrusion 814.

The attachment plate 504 comprises a perimeter 606, a top surface 608, and a bottom surface 706. The perimeter 606 is formed by a base 610 with an exterior surface 616 and an interior surface 708, and one or more sidewalls 612. The base 610 may have openings 812 from the exterior surface 616 to the interior surface 708. Each securing element 506 may be placed into one of the openings 812 and extend from both the interior surface 708 and the exterior surface 616 of the base 610. The openings 812 may have opposing threads that match the threads 822 of the securing element 506. Each sidewall 612 may comprise one or more openings 614 into which a protrusion 814 may be mounted and secured. A portion of a protrusion 814 may be secured to one of the openings 614. The portion may be the threads 816 matching and engaging opposing threads in the openings 614 in some embodiments, or may be a peg utilizing friction in the openings 614 in other embodiments. Each protrusion 814 is configured to engage a guide 810 of the base plate 502.

The securing element 506 comprises body 818 having a first end and a second end with a knob 820 at the first end and threads 822 at the second end. The knob 820, in this embodiment, is configured in an ergonomic design to be grasped by a user and pulled away from the exterior surface 616 of the base 610 of the attachment plate 504. The securing element 506 further comprises a tube contact 824 affixed to the second end of the body 818, a nut 826, and an elastic element 828. The elastic element 828 is secured between the nut 826 and the interior surface 708 of the base 610 of the attachment plate 504.

A tubular member 408 may be placed within one of the receivers 806 while the pinball-style tube holder 600 is in the open position. Each protrusion 814 is then aligned with a corresponding guide 810. When aligned as such, the securing element 506 is aligned with one of the receivers 806. In embodiments with multiple securing element 506 and receivers 806, each securing element 506 is aligned with a corresponding one of the receivers 806. Each protrusion 814 is then inserted into the corresponding guide 810 to place the pinball-style tube holder 600 into the closed position. While in the closed position, the tubular member 408 may physically contact one of the receivers 806 and the tube contact 824 of the securing element 506. The tube contact 824 may engage the nut 826 and the elastic element 828 to secure the tubular member 408.

The pinball-style tube holder 600 may further comprise a latch 710. The latch 710 comprises a clasp 712, a swing arm 714, and a catch 716. The clasp 712 is affixed to the bottom surface 702 of the base plate 502 and the catch 716 is affixed to the bottom surface 706 of the attachment plate 504 opposed to the clasp 712. The swing arm 714 is moveable from a first position to a second position to engage the catch 716, which helps fixation of the pinball-style tube holder 600 in the closed position. In other embodiments, the latch 710 further comprises a lock. The lock acts to help inhibit the latch 710 from disengaging (i.e., the swing arm 714 separating from the catch 716) during operation in various configurations, such as in embodiments where the clasp 712 is affixed to the top surface 604 of the base plate 502 and the catch 716 is affixed to the top surface 608 of the attachment plate 504. The clasp 712 may also comprise a spring-loaded first tab engaging a second tab. The spring-loaded first tab and the second tab help inhibit the latch 710 from disengaging during operation of the pinball-style tube holder 600.

Figure 12:
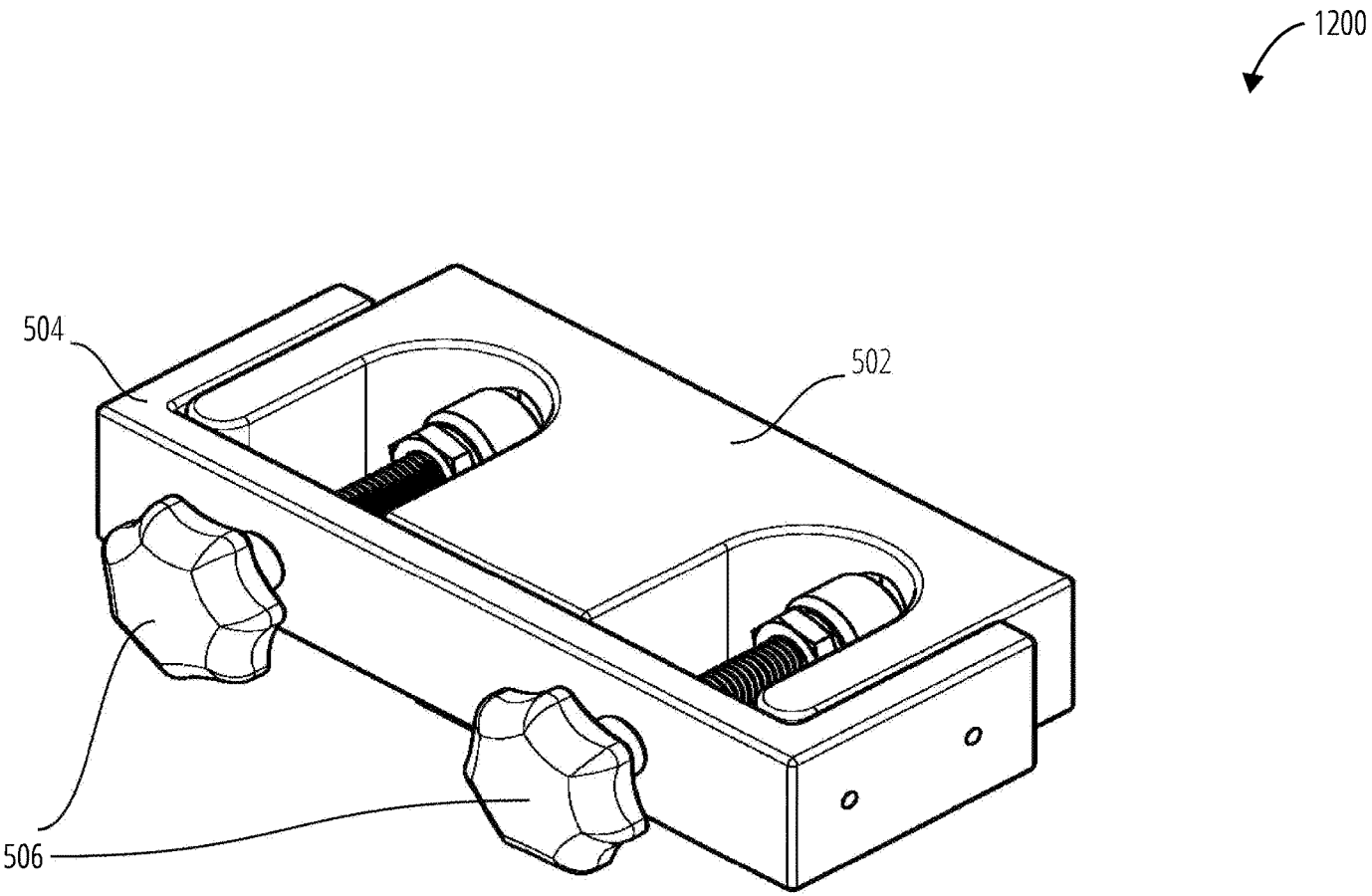
FIG. 12 illustrates a top perspective assembly view of an embodiment of a screw-style tube holder 1200 in the closed position.
Figure 13:
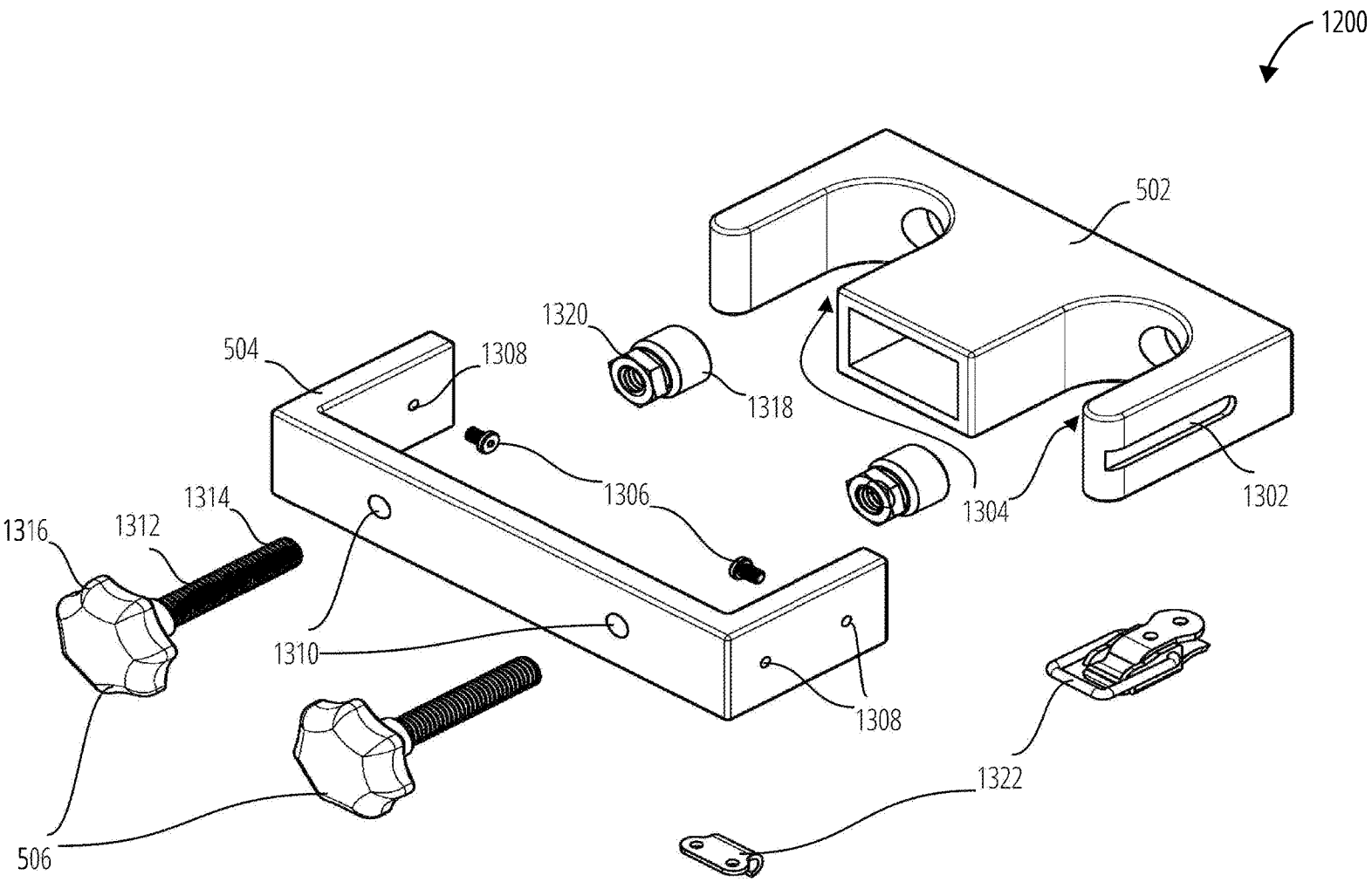
FIG. 13 illustrates a top perspective exploded view of an embodiment of a screw-style tube holder 1200.

Referring to FIG. 12 and FIG. 13, a screw-style tube holder 1200 is depicted in an assembled view and an exploded view. The screw-style tube holder 1200 comprises a base plate 502, an attachment plate 504, a securing element 506, and a latch 1322.

The base plate 502 comprises a perimeter joining a top surface to a bottom surface. The base plate 502 also comprises a guide 1302 and receivers 1304. The base plate 502 may have a second guide (not depicted). The guide 1302 may be mounted onto or indented into the base plate 502, extending from the front to the back of the base plate 502. The base plate 502 may comprise more than one guide 1302. For example, a guide 1302 may be located on each side of the base plate 502. Each guide 1302 may be configured to receive one of the protrusions 1306 of the attachment plate 504. Each of the receivers 1304 receive a tubular member 408, which may then be secured to the receivers 1304 by the securing element 506.

The attachment plate 504 may comprise a perimeter joining a top surface to a bottom surface, as well as one or more protrusions 1306, wherein each of the protrusions 1306 may be mounted and secured to one of the openings 1308 in the perimeter. The protrusions 1306 may have a peg that is secured by friction to the openings 1308 or have threads that match and secure to opposing threads in the openings 1308. The attachment plate 504 also comprises openings 1310. The openings 1310 may have opposing threads that match the threads 1314 of the securing element 506.

The securing element 506 comprises a body 1312, threads 1314, a knob 1316, a tube contact 1318, and a nut 1320. The body 1312 has a first end and a second end. The first end has the knob 1316, which may be adjacent to the exterior surface of the base of the attachment plate 504. In this embodiment, the knob 1316 is configured in an ergonomic design to be grasped by a user and rotated to engage the threads 1314 with the matching opposing threads in the openings 1310 thereby translating the tube contact 1318 of the securing element 506 either toward or away from the base of the attachment plate 504. When aligned with a base plate 502 with a tubular member 408 within the receivers 1304, the tube contact 1318 may be translated toward the tubular member 408. The movement of the tubular member 408 is then restrained by physically contacting the tube contact 1318 and the receivers 1304.

The latch 1322 comprises a clasp, a swing arm, and a catch. The clasp is affixed to the base plate 502, and the catch is affixed to the attachment plate 504 opposed to the clasp. The swing arm is moveable from a first position to a second position to engage the catch, which acts to fix the screw-style tube holder 1200 in the closed position. In other embodiments, the latch 1322 comprises a lock. The lock acts to help inhibit the latch 1322 from disengaging (i.e., the swing arm separating from the catch) during operation in various configurations, such as in embodiments where the clasp is affixed to the top surface of the base plate 502 and the catch is affixed to the top surface of the attachment plate 504. The clasp may also comprise a spring-loaded first tab engaging a second tab. The spring-loaded first tab and the second tab help inhibit the latch 1322 from disengaging during operation of the screw-style tube holder 1200.

Figure 14:
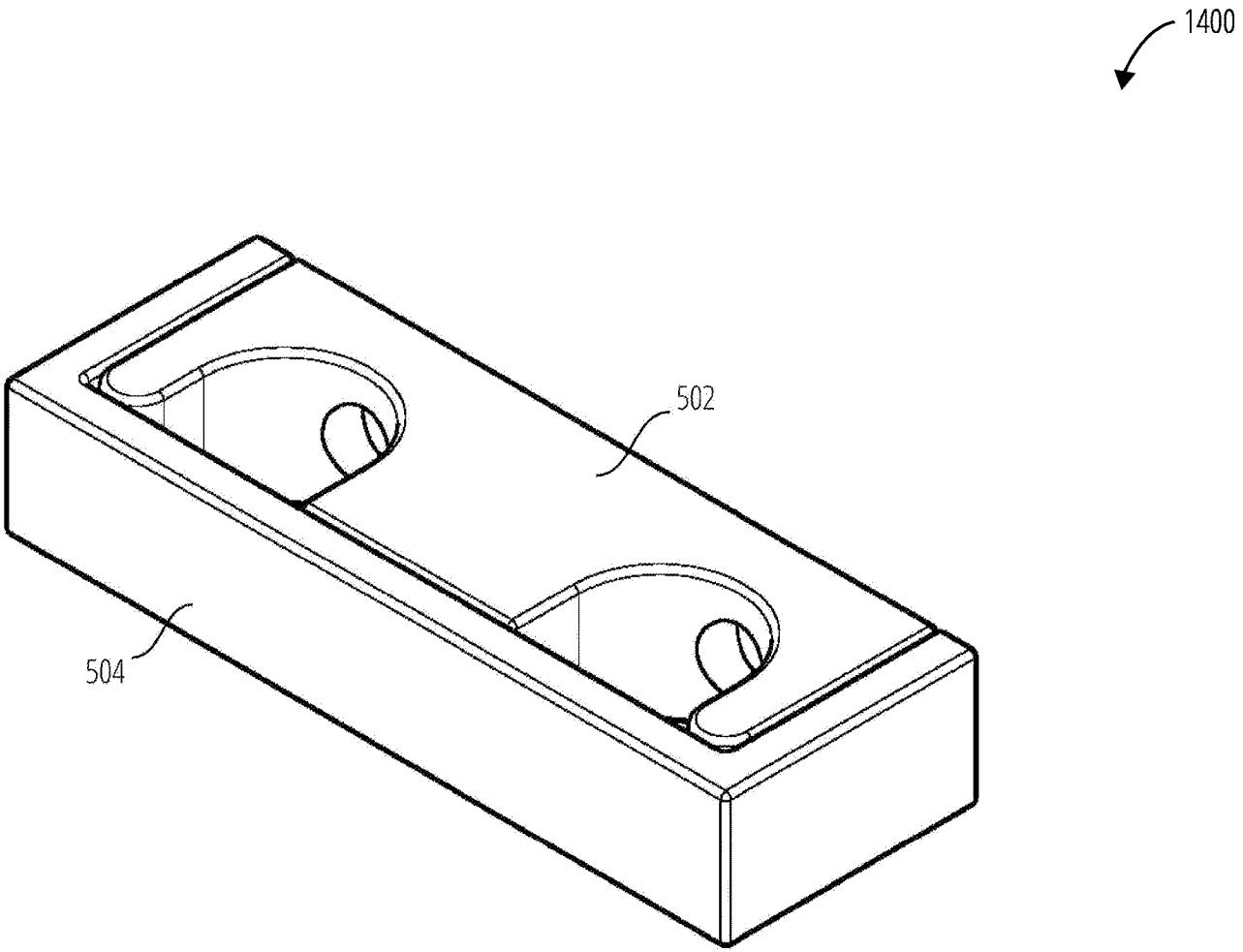
FIG. 14 illustrates a top perspective assembly view of an embodiment of a cover-style tube holder 1400 in a closed position.
Figure 15:
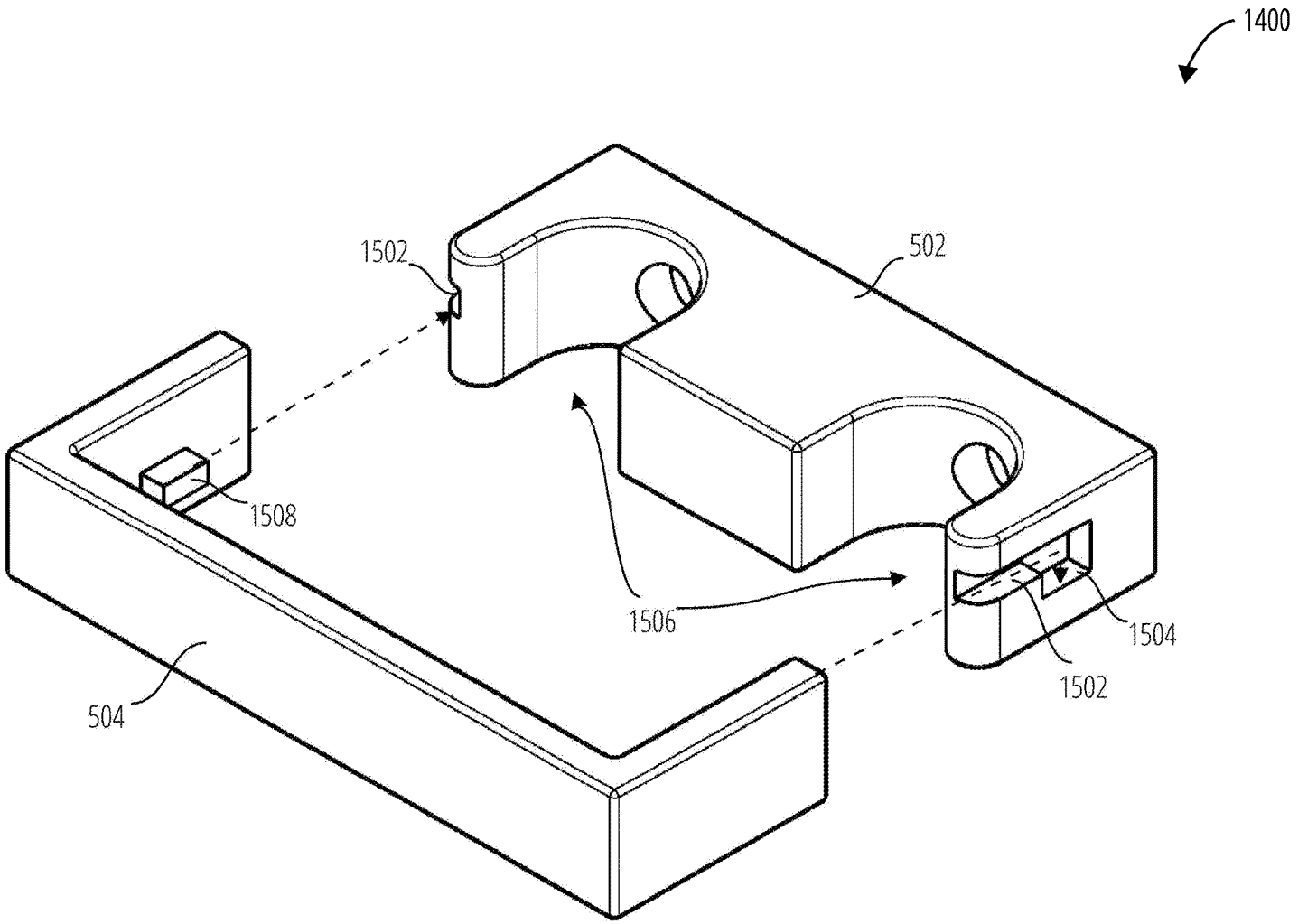
FIG. 15 illustrates a top perspective assembly view of an embodiment of a cover-style tube holder 1400 in an open position.

Referring to FIG. 14 and FIG. 15, a cover-style tube holder 1400 is depicted in a closed position and an open position. The cover-style tube holder 1400 comprises a base plate 502 and an attachment plate 504. In this embodiment, a securing element 506 is absent, with the tubular member 408 being secured between the base plate 502 and the attachment plate 504.

The base plate 502 comprises a perimeter joining a top surface to a bottom surface. The base plate 502 comprises guides 1502, each of which having a notch 1504. The guides 1502 and each notch 1504 may be mounted onto or indented into the sidewalls of the base plate 502. The guides 1502 and notch 1504 receive the protrusion 1508 of the attachment plate 504. The protrusion 1508 slides along the corresponding guide until it is aligned with the notch 1504. The protrusion 1508 then slides into the corresponding notch 1504. The notch 1504 may be oriented below its guide to utilize gravity to help maintain the closed position. Each protrusion 1508 may be offset relative to the guides 1502, such that as each protrusion 1508 is sliding through the guides 1502, the attachment plate 504 is offset relative to the base plate 502. When each protrusion 1508 slides into its corresponding notch 1504, the top surfaces and bottom surfaces of the attachment plate 504 and the base plate 502 may be even with each other. The base plate 502 may further comprise one or more receivers 1506. Each of the receivers 1506 may receive a tubular member 408. The tubular member 408 may be secured by the attachment plate 504 in the closed position.

The attachment plate 504 may comprise a perimeter joining a top surface to a bottom surface, as well as one or more protrusions 1508, wherein each protrusion 1508 may be mounted and secured to the perimeter. In some embodiments, each protrusion 1508 is integral to the perimeter of the attachment plate 504. The protrusion 1508 may also be a peg that is secured by friction to an opening or indentation in the perimeter of the attachment plate 504.

In some embodiments, a latch is utilized to maintain the base plate 502 and the attachment plate 504 in the closed position. The latch may have a clasp attached to the base plate 502 and an opposing catch attached to the attachment plate 504. A swing arm affixed to the clasp is moveable from a first position to a second position to engage the catch.

Figure 16:
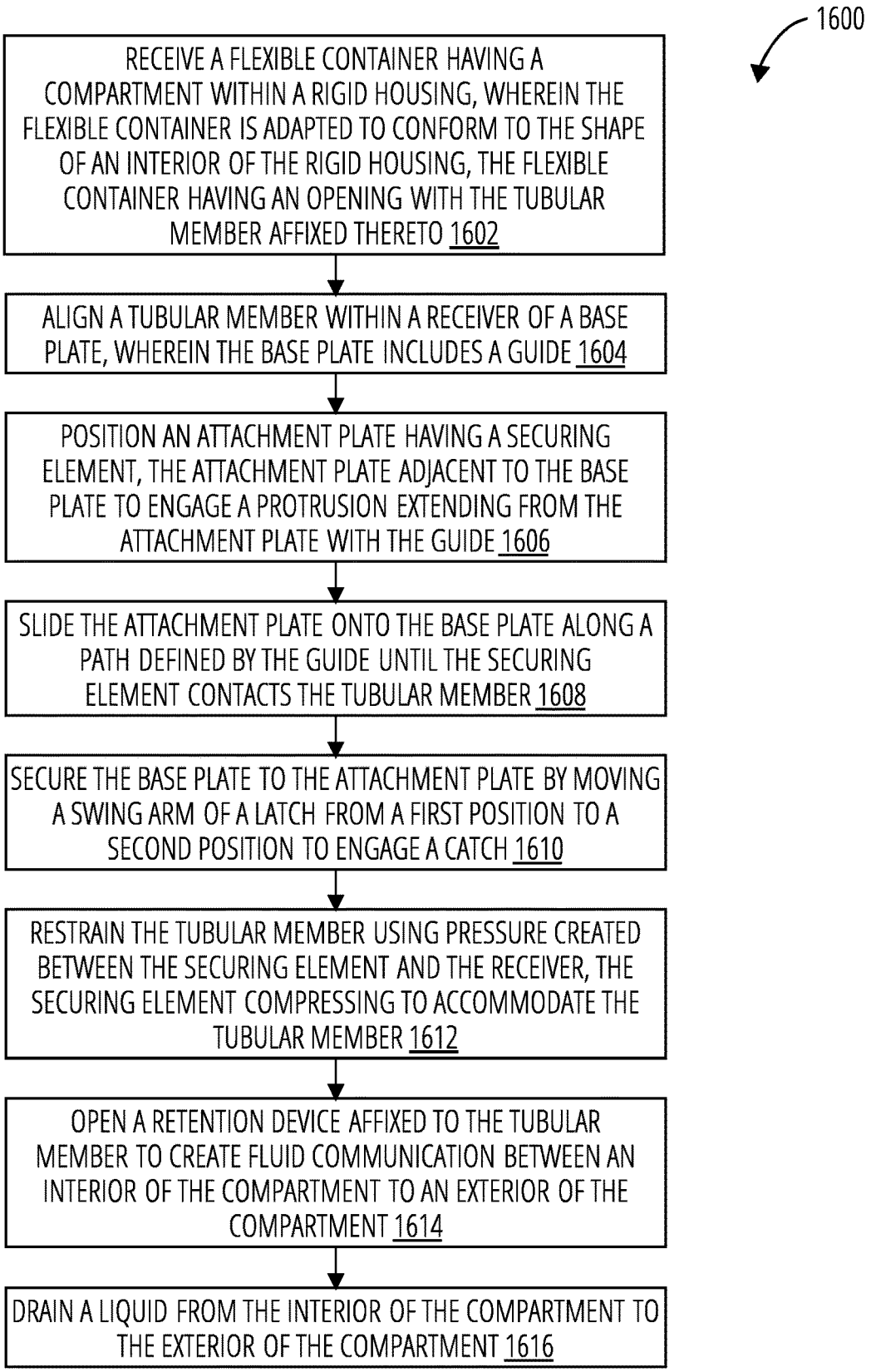
FIG. 16 illustrates an embodiment of a method 1600.

Referring to FIG. 16, a method 1600 comprises a flexible container having a compartment is received within a rigid housing, wherein the flexible container is adapted to conform to the shape of an interior of the rigid housing, the flexible container having an opening with the tubular member affixed thereto (block 1602). A tubular member is aligned within a receiver of a base plate, wherein the base plate includes a guide (block 1604). An attachment plate having a securing element, the attachment plate adjacent to the base plate is positioned to engage a protrusion extending from the attachment plate with the guide (block 1606). The attachment plate is slid onto the base plate along a path defined by the guide until the securing element contacts the tubular member (block 1608). The base plate is secured to the attachment plate by moving a swing arm of a latch from a first position to a second position to engage a catch (block 1610). The tubular member is restrained using pressure created between the securing element and the receiver, the securing element compressing to accommodate the tubular member (block 1612). A retention device affixed to the tubular member is opened to create fluid communication between an interior of the compartment to an exterior of the compartment (block 1614). A liquid is drained from the interior of the compartment to the exterior of the compartment (block 1616).

Figure 17:
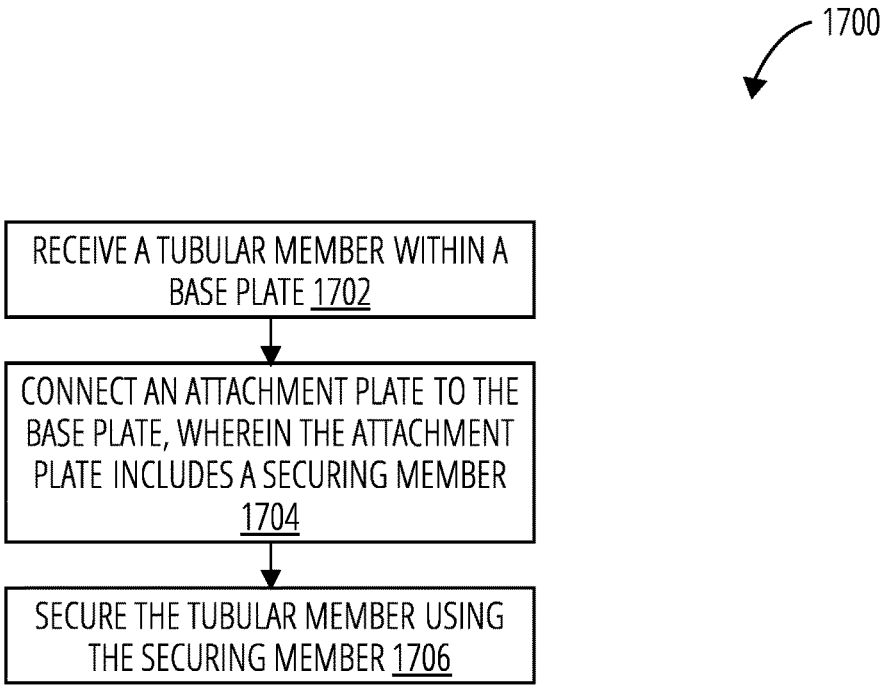
FIG. 17 illustrates an embodiment of a method 1700.

Referring to FIG. 17, a method 1700 comprises a tubular member received within a base plate (block 1702). An attachment plate is connected to the base plate, wherein the attachment plate includes a securing member (block 1704). The tubular member is secured using the securing member (block 1706).

Figure 18:
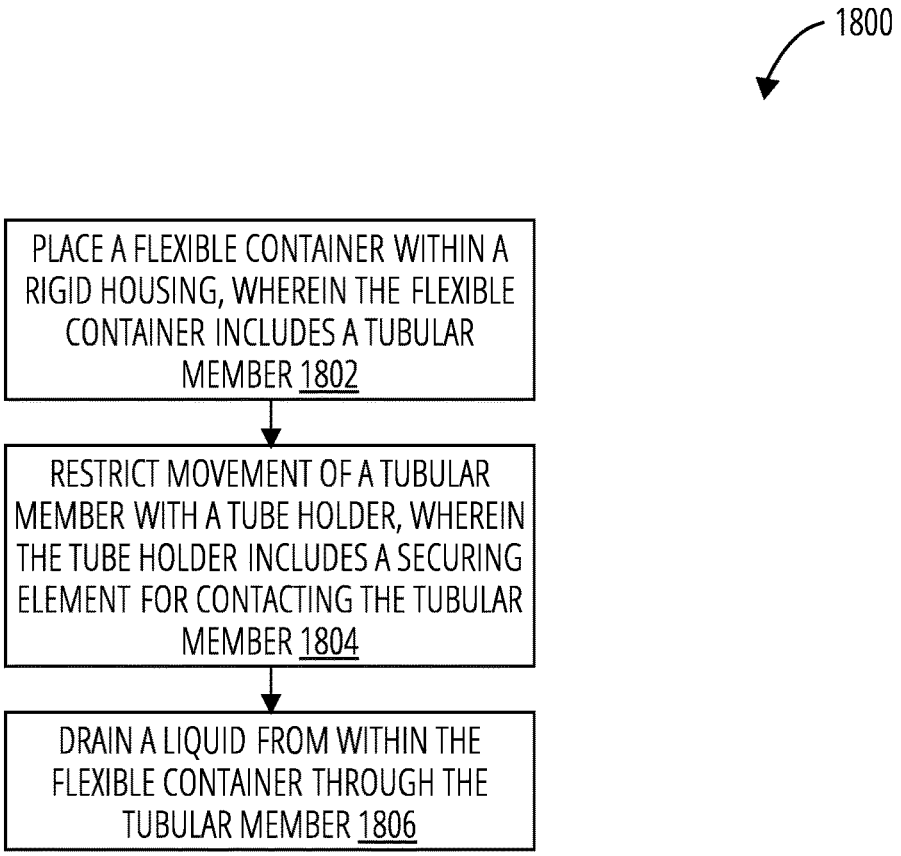
FIG. 18 illustrates an embodiment of a method 1800.

Referring to FIG. 18, a method 1800 comprises a flexible container placed within a rigid housing, wherein the flexible container includes a tubular member (block 1802). Movement of a tubular member is restricted with a tube holder, wherein the tube holder includes a securing element for contacting the tubular member (block 1804). A liquid from within the flexible container is drained through the tubular member (block 1806).

What is claimed is:

1. A method for positioning an object within a support, comprising:

aligning a tubular member within a receiver of a base plate, wherein the base plate includes a guide;

positioning an attachment plate adjacent to the base plate so that a protrusion extending from the attachment plate engages with the guide of the base plate, a securing element being disposed on the attachment plate; and sliding the attachment plate onto the base plate along a path defined by the guide until the securing element contacts the tubular member.

2. The method of claim 1, further comprising the step of restraining the tubular member using pressure created between the securing element and the receiver.

3. The method of claim 2, wherein the securing element extends from an interior surface of the attachment plate and includes an elastic element.

4. The method of claim 1, further comprising the step of receiving a flexible container having a compartment within a rigid housing, wherein the flexible container is adapted to conform to a shape of an interior of the rigid housing, the flexible container having an opening with the tubular member affixed thereto.

5. The method of claim 4, further comprising the step of opening a retention device affixed to the tubular member to create fluid communication between an interior of the compartment to an exterior of the compartment.

6. The method of claim 5, wherein the retention device is a clamp.

7. The method of claim 5, wherein the base plate comprises a perimeter joining a top surface and an opposing bottom surface, the perimeter forming a back portion, first and second sidewalls, and a curvature encircling a hollow portion to create the receiver.

8. The method of claim 7, wherein the guide includes a first guide mounted to the first sidewall and a second guide mounted to the second sidewall, wherein the first guide and the second guide extend toward the back portion.

9. The method of claim 1, wherein the attachment plate comprises a perimeter joining a top surface and an opposing bottom surface, the perimeter forming a base having an interior surface and an exterior surface and a first sidewall and a second sidewall extending from and on opposing sides of the base.

10. The method of claim 9, wherein the protrusion includes a first protrusion mounted to the first sidewall of the attachment plate and a second protrusion mounted to the second sidewall of the attachment plate.

11. The method of claim 1, further comprising the step of securing the base plate to the attachment plate.

12. The method of claim 11, wherein the securing step incorporates a latch comprising a clasp secured to the base plate and an opposing catch secured to the attachment plate, the clasp including a swing arm.

13. The method of claim 12, further comprising the step of moving the swing arm from a first position to a second position, thereby engaging the catch and fixing the base plate and the attachment plate in a closed position.

14. The method of claim 1, further comprising the step of compressing the securing element to accommodate the tubular member.

15. A method of restraining an object, comprising:

receiving a tubular member within a base plate;

connecting an attachment plate to the base plate with a releasable manual latch, wherein a securing member is disposed on the attachment plate and wherein the releasable manual latch comprises:

a clasp secured to one the base plate or the attachment plate, the clasp including a swing arm; and a catch secured to the other of the base plate or the attachment plate; and securing the tubular member to the base plate using the securing member.

16. A method of removing a liquid from a container, comprising:

housing a flexible container within a rigid housing, wherein the flexible container includes a tubular member;

positioning the tubular member within a receiver of a base plate, the base plate being secured to the housing;

positioning an attachment plate adjacent to the base plate so that a protrusion extending from one of the attachment plate or the base plate engages with a guide formed on the other of the attachment plate or the base plate;

sliding the attachment plate onto the base plate by the protrusion sliding along a path defined by the guide;

restricting movement of the tubular member by a securing element extending from the attachment plate pressing the tubular member against the receiver of the base plate; and draining the liquid from within the flexible container through the tubular member.

17. A method of restraining an object, comprising:

receiving a tubular member within a base plate;

connecting an attachment plate to the base plate with a releasable manual latch, wherein a securing member is disposed on the attachment plate; and securing the tubular member to the base plate using the securing member, further comprising:

a guide formed on one the base plate or the attachment plate, the guide forming a recessed path; and a protrusion extending from the other of the base plate or the attachment plate, wherein the step of connecting the attachment plate to the base plate includes sliding the protrusion along the recessed path of the guide.

* * * * *